United States Patent [19]

McCallum

[11] 4,063,382

[45] Dec. 20, 1977

[54] THROW RING

[75] Inventor: David F. McCallum, Edmonton, Canada

[73] Assignee: The Raymond Lee Organization, Inc., New York, N.Y.

[21] Appl. No.: 742,332

[22] Filed: Nov. 16, 1976

[51] Int. Cl.[2] ..... A63H 27/00

[52] U.S. Cl. ..... 46/74 D; 273/106 B

[58] Field of Search ..... 46/74 R, 74 D, 79, 114, 46/220, 1 H, 1 R; 273/100, 106 B, 106 R, 106 F, 99, 126 R, 106 D, 106 G, 128 R, 128 A; 244/23 C, 12.2; D34/15 G, 15 HS

[56] References Cited

U.S. PATENT DOCUMENTS

| | | | |
|---|---|---|---|
| 3,742,643 | 7/1973 | Keith | 46/74 D |
| 3,765,122 | 10/1973 | English | 46/74 D |

*Primary Examiner*—Louis G. Mancene
*Assistant Examiner*—Mickey Yu
*Attorney, Agent, or Firm*—Howard I. Podell

[57] ABSTRACT

A circular hollow ring of circular cross-section which may be tossed in the air. Three airfoil-shaped fins are each mounted equidistantly about the inner circumference of the ring to provide aerodynamic properties to the ring when it is tossed in a manner, causing the ring to rotate in the air.

4 Claims, 4 Drawing Figures

THROW RING

SUMMARY OF THE INVENTION

My invention is a circular hollow ring of circular cross-section which may be tossed in the air. Three airfoil-shaped fins are each mounted equidistantly about the inner circumference of the ring to provide aerodynamic peoperties to the ring when it is tossed in a manner, causing the ring to rotate in the air.

BRIEF DESCRIPTION OF THE DRAWINGS

The objects and features of the invention may be understood with reference to the following detailed description of an illustrative embodiment of the invention, taken together with the accompanying drawings in whch.

DESCRIPTION OF THE PREFERRED EMBODIMENT

Figure 1:
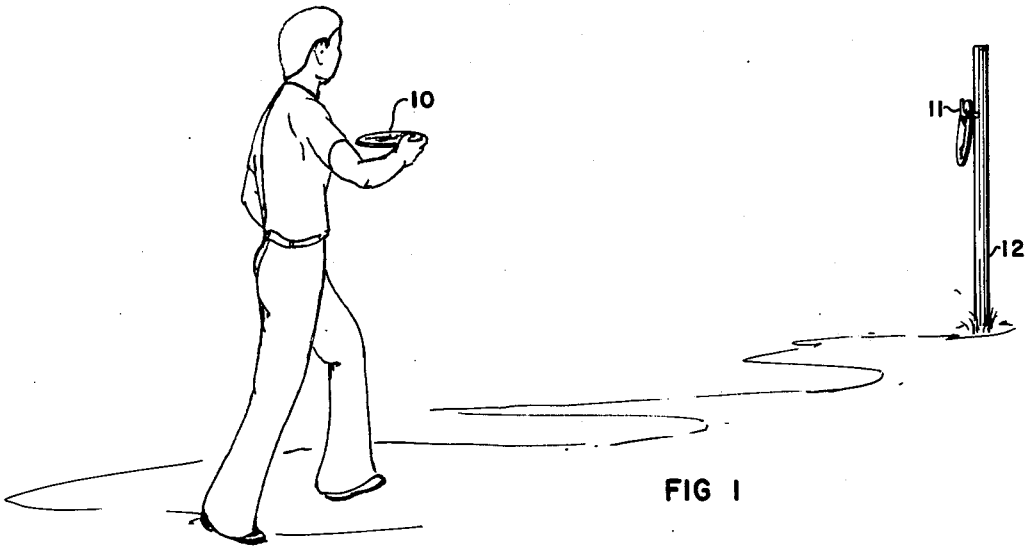
FIG. 1 is a perspective view of the invention tossed to be caught on a hook.
Figure 2:
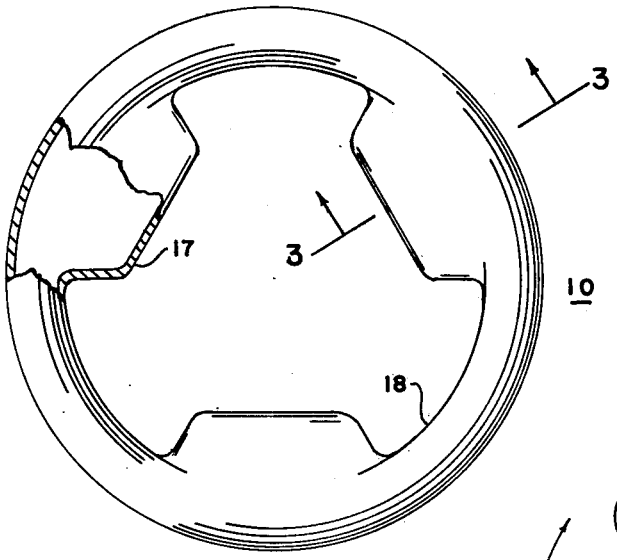
FIG. 2 is a plan view of the invention.
Figure 3:
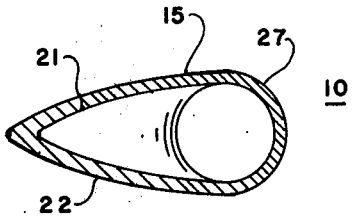
FIG. 3 is a sectional view of the invention, taken along line 3—3 of FIG. 2.

Turning now descriptively to the drawings, in which similar reference characters denote similar elements throughout the several views, FIGS. 1–3 illustrate the throw ring 10 which may be tossed with a twirling motion to cause the ring to fly as it rotates towards a hook 11 mounted on a pole 12 or towards a person who can catch the ring.

Ring 10 is formed of a circular ring section 15 of hollow tubing 16 with three fins 17 mounted at equidistant points to the inner circumferential section 18 of the ring section.

Each fin is of hollow construction and is formed of a rounded triangular shape upper surface section 21 joined to a rounded triangular shaped lower section 22.

Figure 4:
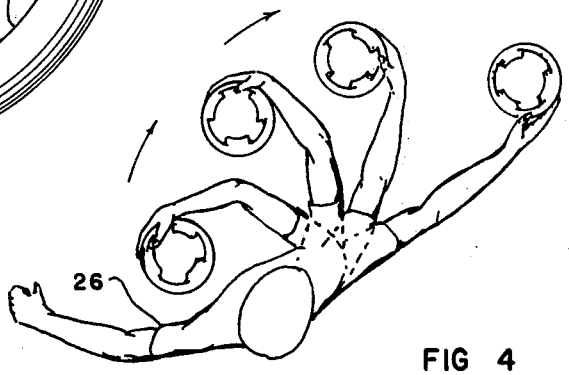
FIG. 4 is a plan view of the invention in use.

The external surfaces of sections 21 and 22 are preferably of a convex shape to provide lift when the ring 10 is rotated by a tosser 26 who flings the ring as shown in FIG. 4 so as to cause it to rotate about its axis, in flight.

The external circumferential surface 27 of ring 10 is relatively smooth and free of projection from the circular ring section 15 so as to avoid injury to a person catching a tossed ring.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A throw ring in the shape of a tube formed as a continuous ring, with a plurality of spaced fins fixed to the inside circumferential surface of the ring, with each fin shaped with a convex external surface to provide aerodynamic lift properties to the ring, when rotated, with each said fin radially projecting from the inside circumferential surface of the ring as an integral extension of the adjacent surface of the ring for a fractional arcuate portion of the circumference of said surface, said fins spaced substantially about said inside circumferential surface, with said fins bounding a completely open central recess portion.

2. The combination as recited in claim 1 in which three fins are mounted at equidistant locations along the inner circumferential ring surface.

3. The combination as recited in claim 1 in which each fin is formed with a convex external upper surface joined to a convex external lower surface at the inner perimeter of said fin.

4. The combination as recited in claim 1 in which the tube and the fins are of hollow construction.

* * * * *